US006402709B1

(12) United States Patent
Wu

(10) Patent No.: US 6,402,709 B1
(45) Date of Patent: Jun. 11, 2002

(54) CYCLICALLY DRIVEN, STRAIGHTLY AND RECIPROCALLY MOVING MASSAGE DEVICE

(76) Inventor: Dong-Her Wu, No. 141, Sec. 2, Chang-Shui Road, Pu-Yen Hsiang, Chang-Hua Hsien (TW)

( * ) Notice: Subject to any disclaimer, the term of this patent is extended or adjusted under 35 U.S.C. 154(b) by 0 days.

(21) Appl. No.: 09/606,044

(22) Filed: Jun. 29, 2000

(51) Int. Cl.[7] ..... A61H 7/00

(52) U.S. Cl. ..... 601/98; 601/99; 601/101; 601/103; 601/112

(58) Field of Search ..... 601/97, 98, 99, 601/101, 102, 103, 112, 113, 115, 116, 122, 124, 126, 128

(56) References Cited

U.S. PATENT DOCUMENTS 4,570,617 A * 2/1986 Baus ..... 128/52
4,757,808 A * 7/1988 Effler, Jr. ..... 128/66
5,807,288 A * 9/1998 Wu ..... 601/99
6,039,705 A * 3/2000 Wu ..... 601/99

* cited by examiner

*Primary Examiner*—Michael A. Brown
*Assistant Examiner*—Benjamin K. Koo

(57) ABSTRACT

A cyclically driven, straightly and reciprocally moving massage device for positioning rotary massage components is installed in the interior section of a back massage chairs or pillows, enabling an axial moving applied upon the user. The massage components of the device are capable of rotating and straightly moving continuously. The device consists of a base plate having a driving gear and a driven gear, and a base mounting plate. The base plate has studs for pivotably mounting the driving disk and driven disk, respectively. A cyclically moving chain or a timing belt is installed around the outer circumference of the driving disk and the driven disk so as to formed with a loop for transmitting moving forces. Furthermore, different structural type massage components are selectively utilized to provide continuous rotation modes without any power supply or circuit wiring on the base mount to thereby facilitate the maintenance of motion.

4 Claims, 5 Drawing Sheets

FIG 5-A

CYCLICALLY DRIVEN, STRAIGHTLY AND RECIPROCALLY MOVING MASSAGE DEVICE

BACKGROUND OF THE INVENTION

1) Field of the Invention

The present invention relates to massage devices, and particularly to a cyclically driven, straightly and reciprocally moving massage device.

2) Description of the Prior Art

Conventional massage devices have various massage rollers or massage components positioned at a lower side of the devices. A motor, or gears, or linkages are used to drive the structure. The motor at the lower side is used as a motion source for driving the massage devices. Such devices that dispose the massage components driving structure at the lower side extent of a motor shaft have the advantages of structural simplicity and low error rate. The devices are especially suitable for being used in conventional handheld or fixed-type (with fixed massage positions) massage devices. However, if it is utilized in the interior of back massage chairs (such as massage chairs), pillows (such as massage pillows), and so on, since they must be capable of moving reciprocally within a distance of about 40 cm to 60 cm width along the back of the user, a power supply area as well as two extending power supply and circuit control cables are necessary, however, this extends over the entire spatial extent of the device. Moreover, when the massage components are in a state of moving reciprocally, both the power supply cable and circuit control cable will continuously stretch and release. As such, due to the unceasing coiling and uncoiling operations, electrical short circuit and poor continuity occur at the contact areas of the circuit. Since both the power supply cable and the circuit control cable cannot be integrally mounted while still provides an acceptable traveling length, the massage component cable induces an obstruction during reciprocal motion and is susceptible to damage, resulting in the malfunctioning of the massage device.

In extreme cases, since the back of the user is directly exposed to the energized base mounting box area of the massage components, if poor contact or short circuiting occurs, the user will subject to injury or shock from the electrical leakage and this is the most serious shortcoming of such structures.

Furthermore, since such massage components must be additionally equipped with a motor power supply structure, the force of the axially driving structure and the separated power supply not only results in additional installation procedures that not only involves assembly and wiring difficulties, but also raises production cost and affects economic feasibility, while also increasing the probability of malfunction. Therefore, this approach is neither reasonable nor practical.

SUMMARY OF THE INVENTION

The primary objective of the present invention is to provide a cyclically driven, straightly and reciprocally moving massage device that position rotating massage components in the interior of a back massage chairs (such as massage chairs) or pillows (such as massage pillows) with an extra installed axially driving structure and a continuously rotating and straight motion massage device. Since the driving disk is driven into rotation by a chain or timing belt.

This will drive a secondary driving disk and a secondary driven disk into continuous rotation, causing the movement of the massage components at the top surface of the secondary driven disk and against back of the user, such that the massage components of the base mounting box do not require other additional power supply or circuit wiring. Therefore, not only the power supply wiring installation time is reduced and facilitated, but also since there are no power supply cabling obstructions, as the entire massage components moves around the shaft of the second driven disk, the smoothness of travel of the base mounting box remains to reduce the malfunction occurrence rate.

Another objective of the present invention is to provide a cycling-type driven, straight motion reciprocal massage device, wherein since the driving disk is located at the lower extent of the base plate, it can be driven by an axially driving moving source (the motor) and also disposed in a shared state, directly reducing the overall assembly and installation production cost and error rate.

The structure, features, functions, and practical objectives of the present invention are further described in the brief description of the drawings below followed by the detailed description of the invention.

BRIEF DESCRIPTION OF THE DRAWINGS

FIG. 5A is an elevational view of FIG. 5.

DETAILED DESCRIPTION OF THE INVENTION

Figure 1:
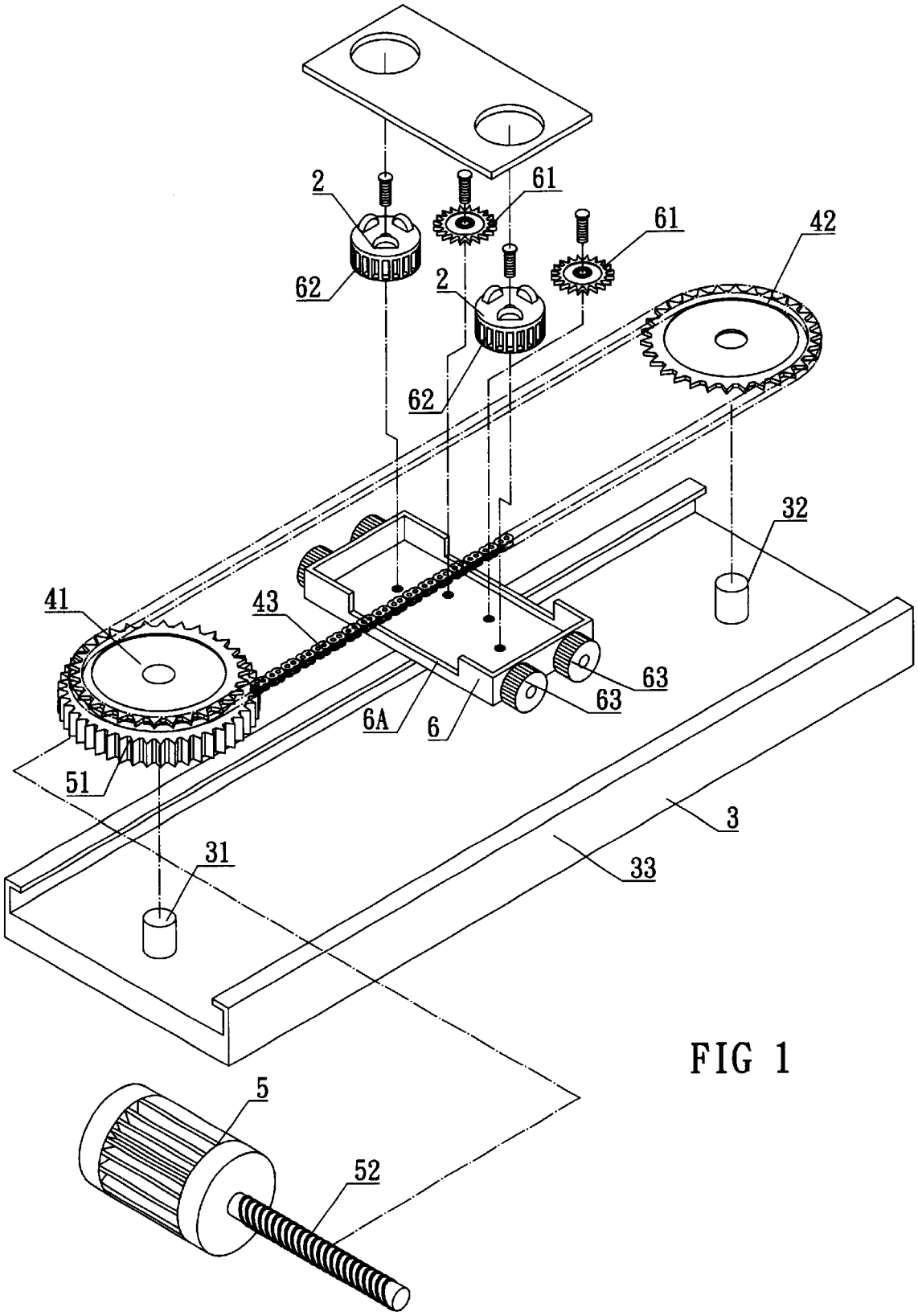
FIG. 1 is an exploded view of the present invention.
Figure 2:
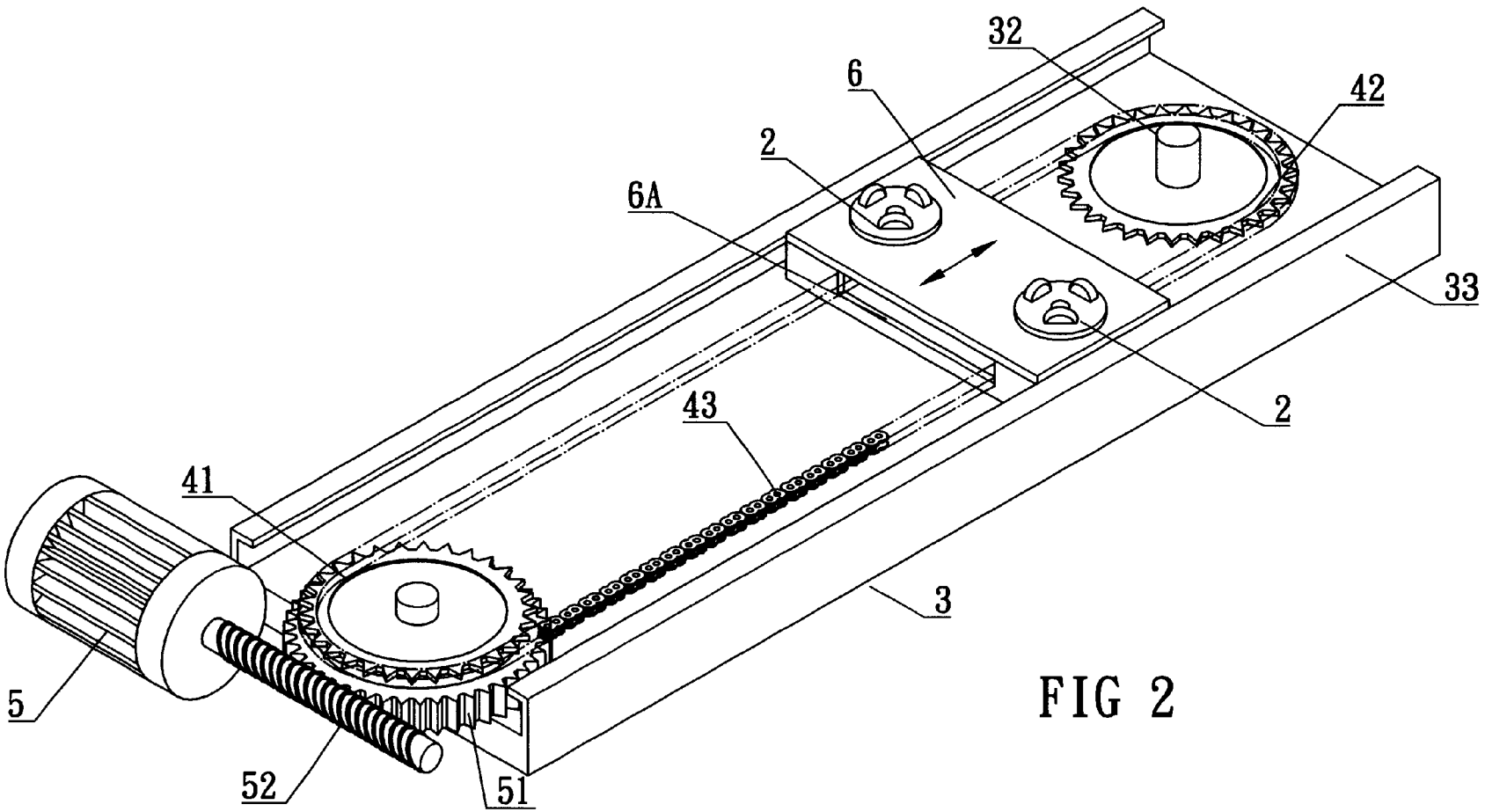
FIG. 2 is a perspective view of the present invention.

Referring to FIG. 1 and FIG. 2, the cyclically driven, straightly and reciprocally moving massage device of the present invention includes a plurality of revolving-type massage components 2 installed in the interior of a back massage chair or pillow (the structure of the massage components is not limited to the structure herein and can be of various types utilized for kneading and rolling, etc.) The disk-type pressure roller 62 shown in the drawings only serves as an example for explanatory purposes, enabling a configuration for executing an axially driving structure (the axially driving structure is no limited as that disclosed therein, other devices such as a rod, a chain, or other structures can be used herein.) capable of executing a continuous rotation and harmonic straight motion of a massage device. The device comprises the following components.

A base plate 3 has two studs 31 which are installed at the upper and lower ends of the top surface of the base plate 3, respectively. Each stud serves for the pivotably mounting driving disks 41 and 42, respectively (the form of the driving disk can be, for example, a sprocket, or a pulley wheel. The sprocket shown in the drawings is only provided for explanatory purposes). A cyclically moving chain 43 (or, alternatively, a timing belt, wherein the chain shown in the drawings is only provided for explanatory purposes) is installed around the outer circumferences of the driving disks 41 and 42 so as to form a loop for power transmission. The driving disk 41 is directly or indirectly driven to rotate by a motor 5 at a rear extent thereof (an indirect drive-type example is shown in the FIG. 3, wherein a gear is installed to the lower extent of the same shaft that is engaged with a rod 52 at a front end of the motor 5).

A base mounting box 6 has a through hole 6A at the center thereof Thereby, the chain 43 (or timing belt, etc.) may pass through the through hole 6A. Two secondary driving disks 61 are mounted in the interior of the base mounting box 6 and are matched with the arrangement of the chain 43 (or timing belt) that are positioned asides. Thereby, they are capable of being engaged by the chain 43 (or timing belt) when the chain is driven to rotate cyclically and thus synchronously transfers the power. Thereby, the chain rotates along fixed shafts. Furthermore, two secondary driven disks are pivotably mounted at and engaged with the sides of the secondary driving disks 61 such that when the secondary driving disks 61 are driven to rotate, the secondary driven disks 62 will rotate synchronously. Massage components 2 are installed on the top surfaces of the secondary driven disks 62. The massage components 2 can be positioned directly against the back surface of the user such that when the secondary driven disks 62 are driven to rotate synchronously. They provide a continuous rotation to performed a massage operation (depending on the structure massage components 2. The operation may be a single point or multiple points massage for various kneading or rolling operation modes).

In the device of the present invention, when the driving disk 41 is driven by the motor 5, the chain 43 (or timing belt) causes the secondary driving disks 61, the secondary driven disks 62, and other components to cyclically move synchronously with the chain 43 (or timing belt) so as to rotate along a fixing shaft. As a result, the massage components 2 of the base mounting box 6 do not require a power supply or circuit wiring for driving the massage components 2 to rotate. Thereby the power supply and wiring installation can be neglected.

Additionally, since the power supply circuit is eliminated, the axially driven structure carried by the entire base mounting box 6 proceeds smoothly during the axial movement process and as such, the error rate is obviously lowered and constitutes another important advantage of the present invention.

Furthermore, since the motor 5 utilized to drive the driving disk 41 is installed at the lower extent of the base plate 3, the moving source of the axially driving structure is transferred via a direct or indirect gear transmission approach so as to reduce the overall assembly and production cost. Further, error rate is also reduced. These are also the advantages of the present invention.

In addition, the secondary driving disks 61 engaged with the chain 43 (or timing belt, etc.) can also be selectively positioned at either the inner side or the outer side of the chain 43 (or timing belt, etc.) for engagement without affecting the cyclically driving massage operation. When there are more than two sets of secondary driving disks 61 or secondary driven disks 62, many positions for axially fixing the secondary driving disks 61 and the secondary driven disks 62 can be selected to achieve the object of setting the positions of the secondary driven disks 62 and massage components 2 so that they may move in various ways.

Figure 3A:
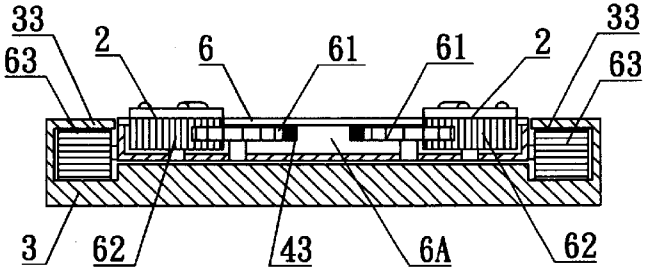
FIG. 3A is a cross-sectional view showing the components of the present invention.
Figure 3:
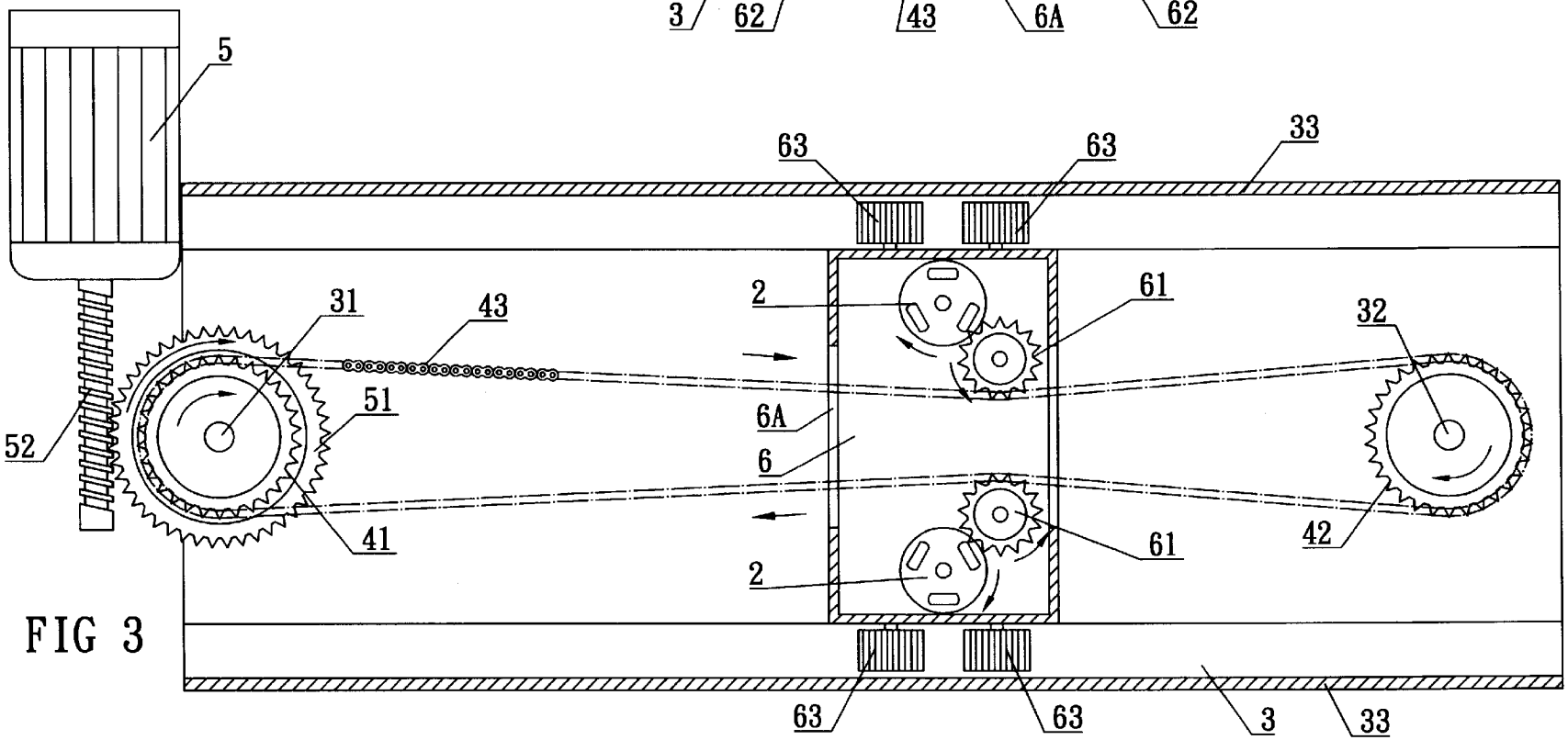
FIG. 3 is an elevational view of the present invention.

Referring to that indicated in FIG. 3, two sets of secondary driving disks 61 and secondary driven disks 62 are positioned in near places and are engaged at the outer side of the chain 43 (or timing belt, etc.) such that when the chain 43 (or timing belt, etc.) is cyclically driven clockwise (refer to the direction of rotation), the two secondary driven disks 62 and the massage components 2 rotate clockwise, namely along the 'same direction", during the driven operation.

Figure 4:
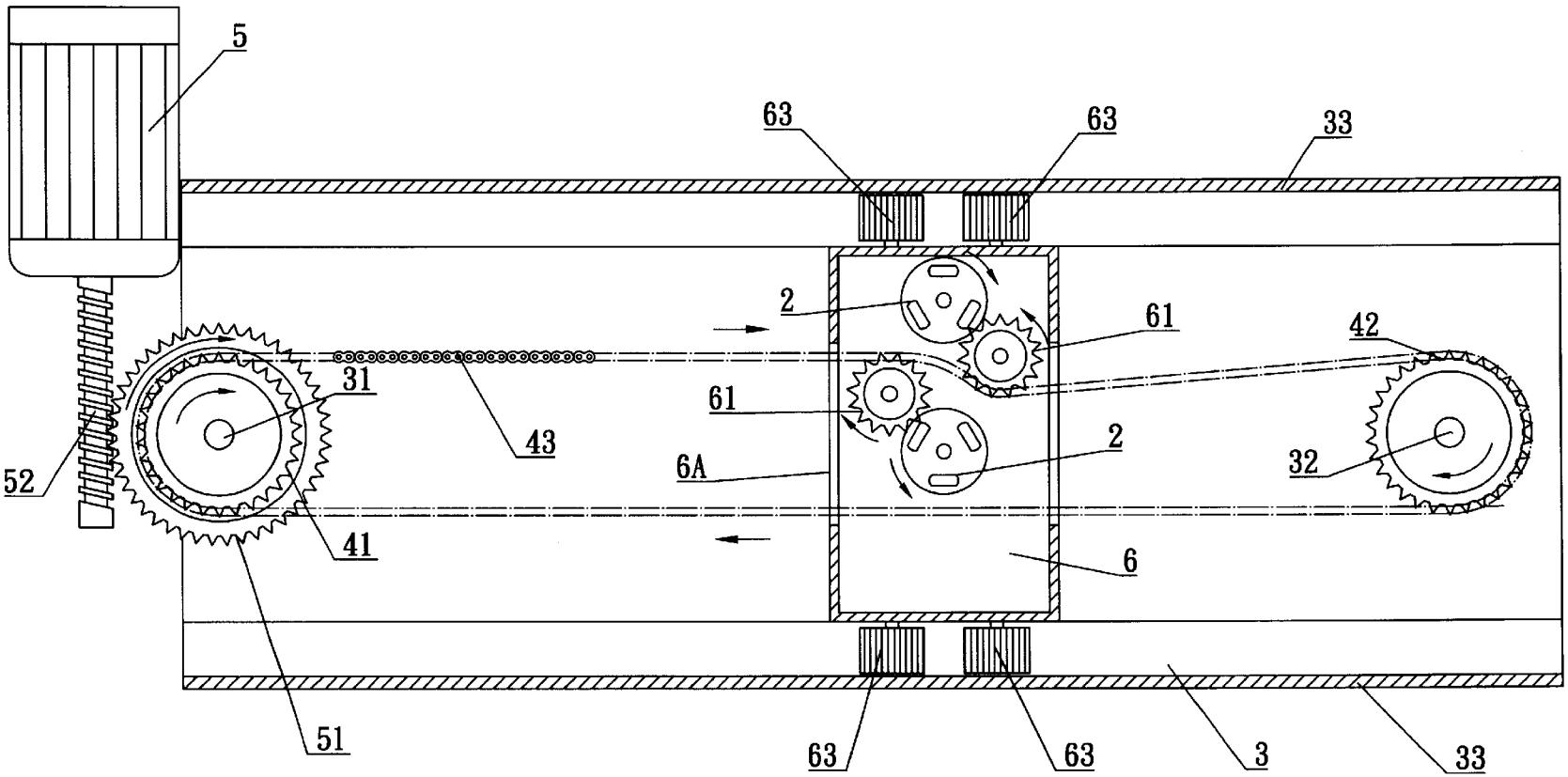
FIG. 4 is an elevational view of the present invention, with the massage components rotating along opposite directions.

Conversely, as indicated in FIG. 4, two sets of secondary driving disks 61 and secondary driven disks 62, respectively, positioned and engaged at the "outer side" and the "inner side" of the chain 43 (or timing belt, etc.) such that when the chain 43 (or timing belt, etc.) is cyclically driven clockwise (refer to the direction of rotation), the two secondary driven disks 62 and the massage components 2, respectively, rotate clockwise and counter-clockwise along "opposite directions" during driven operation.

Therefore, the structure of the present invention actually provides different types of selection ways. Besides, the way for controlling the driving direction of the motor is fixed, and thereby the object of simple structure is achieved.

Additionally, the motion of the present invention is steady for effectively assisting the base mounting box 6 during reciprocal motion by installing roller wheels 63 (or slide blocks) at the sides of the base mounting box 6 that have a traveling area in a position-limiting slide channel 33 (as indicated in FIG. 1, FIG. 2, and FIG. 3) or a stop surface disposed in the lower extent of the base plate 3. This functions as a retaining structure that enables the reciprocal motion of the base mounting box 6 to be effectively steady. Thus, it will not shift toward the left or right sides.

Figure 5:
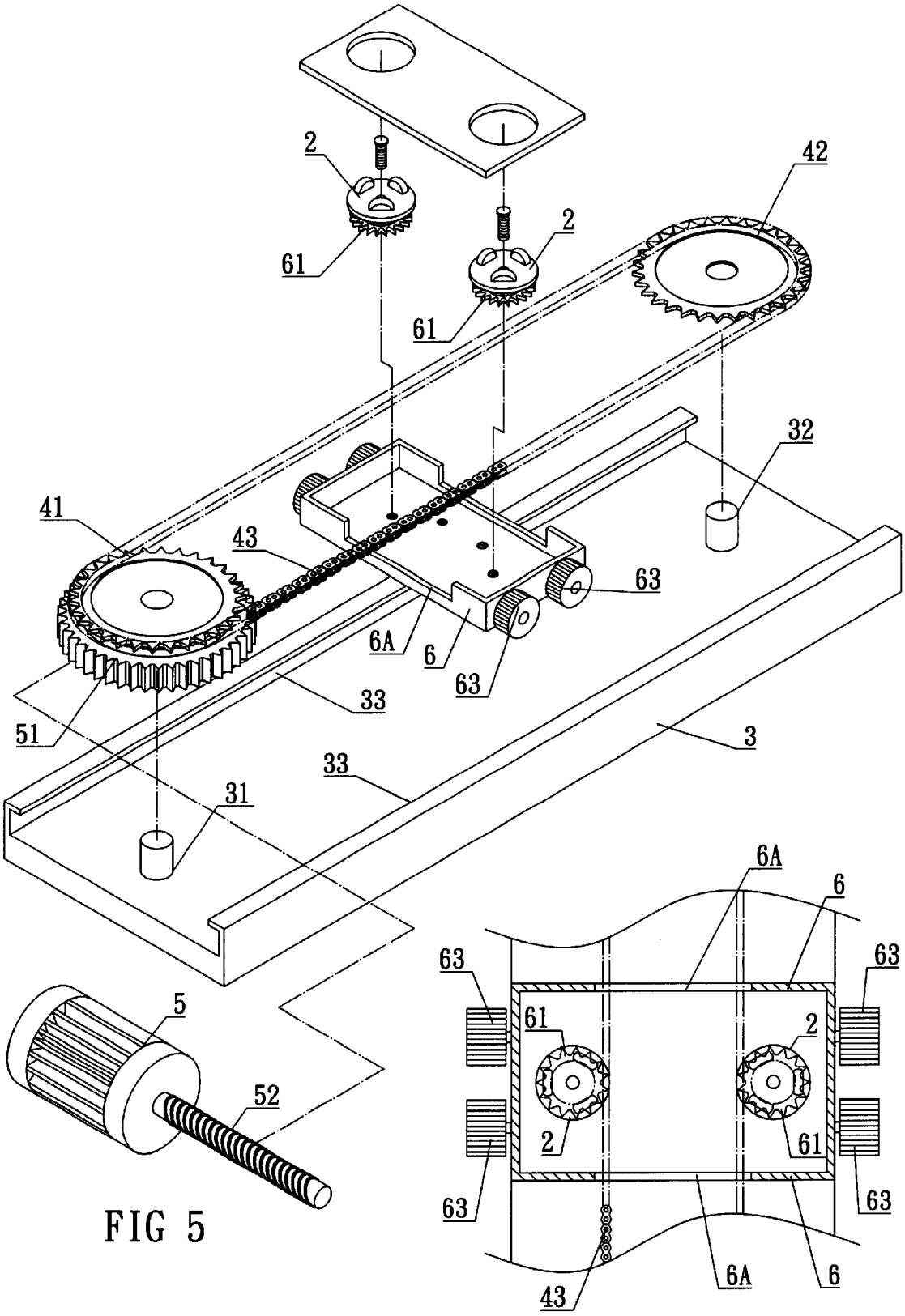
FIG. 5 is an exploded view of another embodiment of the driving shaft and massage components of the present invention.

Referring to FIG. 5 and FIG. 5-A, the top surfaces of the secondary driving disks 61 engaged to the chain 43 can be directly installed on the same shafts as the massage components 2 the structure of which are selective as desired such that when the secondary driving disks 61 are driven to rotate around a fixed axis, the direct driven way causes the driven rotation of the massage components 2 and provides a continuous rotation massage operation. This eliminates the use of another fixed shaft structure, as indicated in FIG. 1. Thereby, the structure of the present invention is simplified.

What is claimed is:

1. A cyclically driven, straightly and reciprocally moving massage device comprising:

a base plate having two studs installed at an upper and a lower ends of a top surface thereof for pivotably mounting one of a sprocket-like and a pulley wheel-like driving disk and one of a sprocket-like and a pulley wheel-like driven disk, respectively; one of a cyclical chain and a timing belt being installed around a circumference of the driving disk; and the driven disk, the driving disk being driven to rotate by a motor at a rear side of the base plate;

a base mounting box having a through hole passing through a center section thereof for being passed by one of the chain and timing belt; at least one secondary driving disk engagable with one of the chain and timing belt being pivotably mounted at an interior of the base mounting box; the secondary driving disks being positioned at a side and engaged with one of the chain and timing belt such that when the secondary driving disk is engaged with one of the chain and timing belt and is driven cyclically, power from the secondary driving disk is transferred synchronously; at least one secondary driven disk is pivotably mounted at a side of a corresponding driving disks such that when the secondary driving disks are driven to rotate around a fixing axis, the secondary driven disk consequently follow a fixing axial rotation synhronously; selective massage components are installed at a top surface of the secondary driven disk with top ends of the massage components projecting from a top surface of the base mounting box, the massage components are positioned directly against a back of the user such that when the secondary driven disks are driven to rotate synchronously, a continuous rotating massage operation is provided;

wherein from above device, when the driving disk is driven to rotate, the chain will execute a cyclic movement and thus cause the massage component to rotate synchronously around a fixing shaft, and thereby the massage components not only move with the chain, but also rotate around the axis of the secondary driven disk.

2. The cyclically driven, straightly and reciprocally moving massage device as claimed in claim 1, wherein the secondary driving disk is selectively engaged at an inner side or an outer side of the said chain or timing belt, thereby, various fixed shaft installation positions are selective so as to set the movement of the massage components to be performed in the same or opposite direction.

3. The cyclically driven, straightly and reciprocally moving massage device as claimed in claim 1, wherein roller wheels or slide blocks are installed at sides of the base mounting box so that the base mounting box have a limited traveling area; this functions as a restrictive retaining structure that enables the reciprocal motion of the base mounting box to be effectively stabilized against drifting or swaying towards the left and right sides.

4. The cyclically driven, straightly and reciprocally moving massage device as claimed in claim 1, wherein a top surface of the secondary driving disk engaged to the chain is installed on the same shafts as the massage components.

* * * * *